US005372753A

United States Patent [19]

Morton

[11] Patent Number: 5,372,753

[45] Date of Patent: Dec. 13, 1994

[54] RAPID ABSORPTION STEAM HUMIDIFYING SYSTEM

[75] Inventor: Bernard W. Morton, Minnetonka, Minn.

[73] Assignee: Dri-Steem Humidifier Company, Eden Prairie, Minn.

[21] Appl. No.: 61,206

[22] Filed: May 13, 1993

[51] Int. Cl.[5] ..... B01F 3/04

[52] U.S. Cl. ..... 261/118; 261/DIG. 76

[58] Field of Search ..... 261/DIG. 76, 118

[56] References Cited

U.S. PATENT DOCUMENTS

| | | | |
|---|---|---|---|
| 3,096,817 | 7/1963 | McKenna | 261/DIG. 76 |
| 3,778,981 | 12/1973 | Ross | 261/DIG. 76 |
| 4,345,916 | 8/1982 | Richards et al. | 261/DIG. 76 |
| 4,508,551 | 4/1985 | Ruoss et al. | 261/DIG. 76 |
| 5,126,080 | 6/1992 | Morton et al. | 261/DIG. 76 |

FOREIGN PATENT DOCUMENTS

| | | | |
|---|---|---|---|
| 6432 | of 1887 | United Kingdom | 261/DIG. 76 |

*Primary Examiner*—Tim Miles

*Attorney, Agent, or Firm*—Woodcock Washburn Kurtz Mackiewicz & Norris

[57] ABSTRACT

An apparatus for introducing steam into an airstream in an HVAC humidification system includes a steam supply header, a steam dispersion tube mounted above the supply header, a drain connected to a bottom end of the steam dispersion tube and a steam supply tube positioned within the steam dispersion tube. The steam supply tube has a lower end communicated with the supply header and an upper end that is communicated with the top end of the steam dispersion tube. Since steam is introduced into the top end of the steam dispersion tube, rather than the bottom end, moisture droplets that are entrained in the steam will be urged downwardly by the steam flow toward the drain rather than held up within the steam dispersion tube, significantly increasing the rate at which steam may be introduced into the airstream without spitting.

25 Claims, 3 Drawing Sheets

RAPID ABSORPTION STEAM HUMIDIFYING SYSTEM

BACKGROUND OF THE INVENTION

2. Field of the Invention

This invention relates to humidification systems that are used in heating, ventilating and air conditioning (HVAC) systems. Specifically, this invention relates to an improved apparatus for introducing steam into an airstream in such a system.

2. Description of the Prior Art

Inadequately humidified air can cause problems that range in severity from merely annoying to extremely expensive or even life threatening. Dry air can make people more susceptible to colds, sore throats and other respiratory problems. It can draw moisture out of materials such as carpet, wood, paper, leather, vinyls, plastics and foods. It can also contribute to generation of static electricity, which can damage electronically sensitive tapes and disks.

Most modern commercial and industrial buildings are equipped with steam humidifiers mounted within the heating and air conditioning systems. Steam from a steam boiler, district steam system or steam-generating humidifier is introduced into a ducted airstream and distributed throughout the building.

Humidification steam cannot be allowed to condense into water in a duct system. Damp areas in ducts become breeding grounds for algae and bacteria, many of which are disease-producing to humans, contaminating to industrial processes, and so forth. To prevent condensation in the duct, the steam must be totally absorbed by the air before the air carries the steam into contact with any internal devices such as dampers, fans, turning vanes etc., within the duct. The more thoroughly the steam is mixed with the air, the shorter the distance it will travel within the duct before becoming absorbed by the air.

Some duct configurations, due to structural limitations imposed by the building design, have very limited open space downstream of the humidifier for absorption of the steam. In order to overcome this problem, modern humidification systems typically utilize closely spaced steam dispersing tubes. Such dispersion tubes can present at least two operational difficulties when closely spaced.

First of all, present day steam dispersion tubes are usually constructed with an outer jacket which contains steam to keep the tube hot. This prevents humidification steam from condensing as it passes through the tube. In closely spaced multiple tube arrangements, such a configuration can present an impediment to air flow within the ducting system. Even more importantly, such a configuration can add unwanted heat to the airstream during periods of cooling. Insulating the exterior surfaces of the hot jacketing can reduce the heat gain, but further aggravates the air flow resistance problem. An automatic valve can be placed in the steam line, supplying steam to the tube jackets and cycling it off and on with the humidifier steam valve. When this has been done, in many cases, the flexing of the tubes caused by heating and cooling has led to eventual cracking of jacket welds.

It is clear there has existed a long and unfilled need in the prior art for a steam injection humidification system that is unaffected by condensation problems, and that is capable of introducing humidity into an airstream consistently and effectively.

SUMMARY OF THE INVENTION

Accordingly, it is an object of this invention to provide a steam injection humidifier that is largely unaffected by condensation problems.

It is further an object of this invention to provide a steam injection humidification system that is more consistent in introducing humidity into an airstream than those which are heretofore known.

It is yet further an object of the invention to provide a steam injection humidifier which accomplishes improved performance while eliminating the attendant problems of resistance to air flow and unwanted heat gain to the airstream.

It is also an object of the invention to provide an injection-type steam humidification system which provides improved mixing action of steam and air over the systems which are presently known.

It is an object of this invention to substantially eliminate "spitting" of small drops of water from the steam injection humidifier into an airstream.

It is another object of this invention to provide a steam injection humidifier which is adaptable to different sizes of the air duct.

It is yet another object of this invention to provide a steam injection humidification system which can be easily disassembled and assembled at an installation site.

In order to achieve these and other objects of the invention, an apparatus for introducing steam into an airstream in an HVAC humidification system includes, according to a first aspect of the invention, a supply header which is adapted for connection to a source of steam; a steam dispersion tube mounted above the supply header, the steam dispersion tube having a top end, a bottom end, and a plurality of orifices defined therein; a drain connected to the bottom end of the steam dispersion tube for draining condensed liquid from the steam dispersion tube; and header communicating structure for communicating the supply header with the top end of the steam dispersion tube, whereby entrained moisture droplets will be urged downwardly in the steam dispersion tube by gravity and the direction of steam flow toward the drain rather than suspended in the steam dispersion tube as would be created by an upward flow of steam.

According to a second aspect of the invention, an apparatus for introducing steam into an airstream in an HVAC humidification system includes a supply header which is adapted for connection to a source of steam; a steam dispersion tube which is mounted above the supply header, the steam dispersion tube having a top end, a bottom end, and a plurality of orifices defined therein; a drain connected to the bottom end of the steam dispersion tube for draining condensed liquid from the steam dispersion tube; and a steam supply tube positioned within the steam dispersion tube, the steam supply tube having a lower end which is communicated with the supply header and an upper end which is communicated with the top end of the steam dispersion tube, whereby steam will be introduced into the top end of the steam dispersion tube and entrained moisture droplets will be urged downwardly in the steam dispersion tube by gravity and the direction of steam flow toward the drain rather than suspended in the steam dispersion tube as would be created by an upward flow of steam.

These and various other advantages and features of novelty which characterize the invention are pointed out with particularity in the claims annexed hereto and forming a part hereof. However, for a better understanding of the invention, its advantages, and the objects obtained by its use, reference should be made to the drawings which form a further part hereof, and to the accompanying descriptive matter, in which there is illustrated and described a preferred embodiment of the invention.

DETAILED DESCRIPTION OF THE PREFERRED EMBODIMENTS

Figure 1:
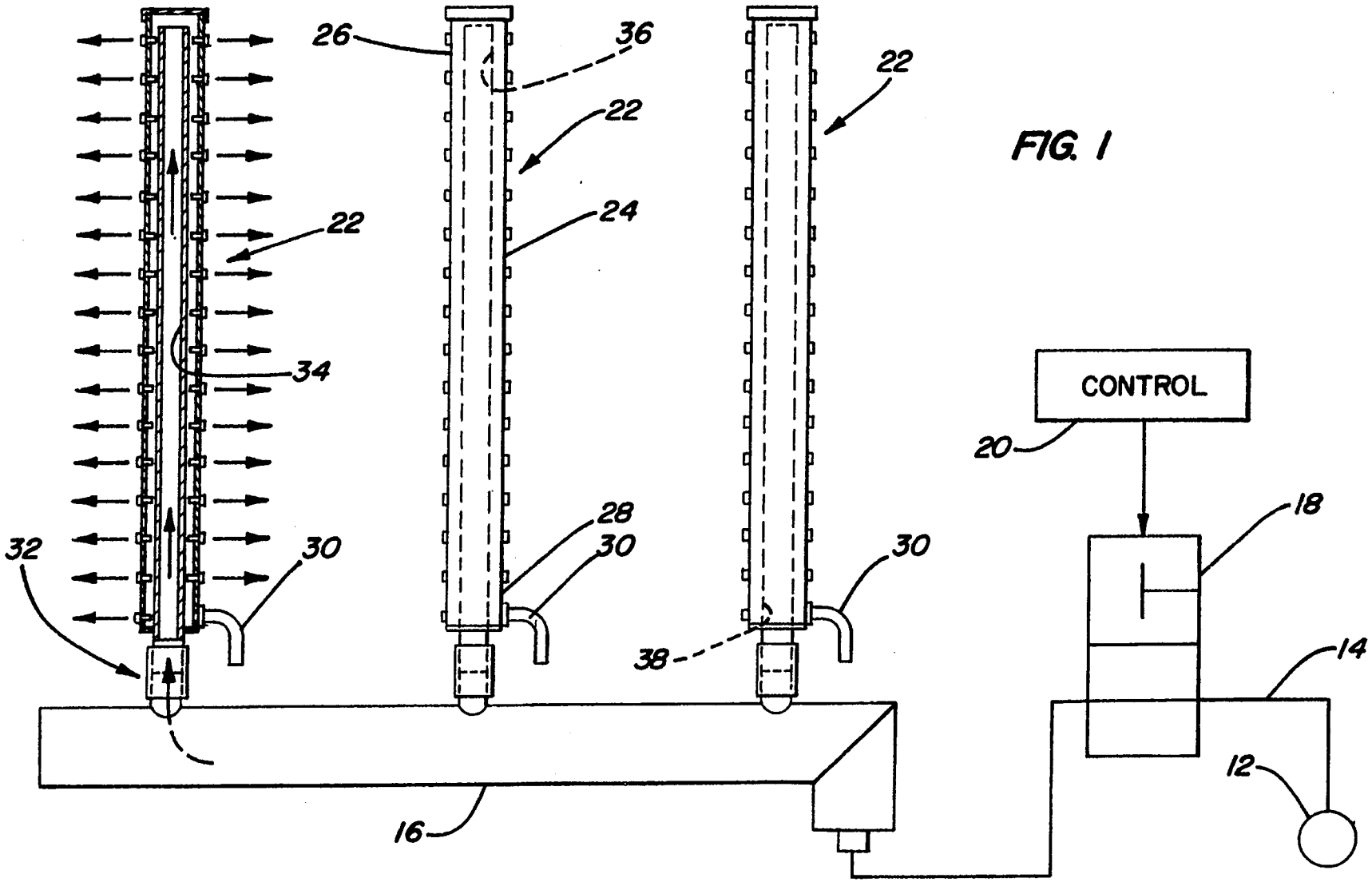
FIG. 1 is a schematic depiction of a humidification system which is constructed according to a preferred embodiment of the invention.
Figure 2:
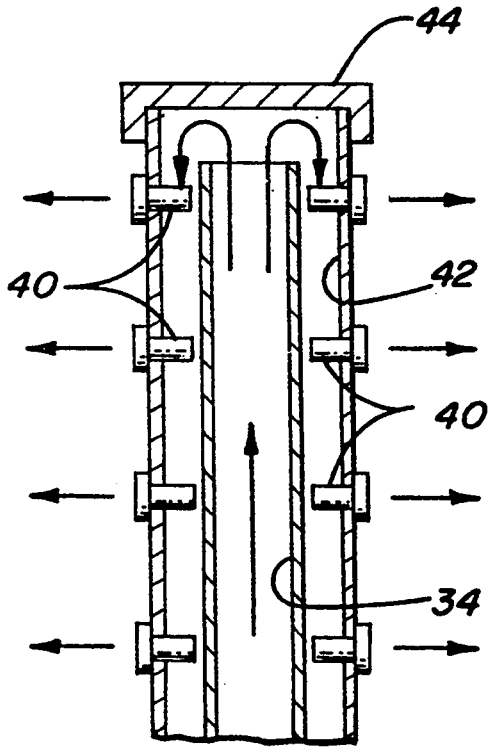
FIG. 2 is an enlarged view of a portion of the system which is depicted in FIG. 1.

Referring now to the drawings, wherein like reference numerals designate corresponding structure throughout the views, and referring in particular to FIGS. 1 and 2, a humidification system 10 constructed according to a preferred embodiment of the invention is shown connected to a source 12 of steam, which is typically a steam boiler, a district steam system or a steam-generating humidifier. A passage 14 communicates source 12 of steam with a supply header 16. A shut-off valve 18 is interposed within passage 14, and a control unit 20 is coupled to control valve 18 for controlling moving valve 18 will be open or closed. Control 20 is typical of those that are well known to those skilled in the art.

As is depicted in FIG. 1, supply header 16 is preferably positioned so that it is substantially horizontal, although it is preferably inclined to a slight degree for permitting condensate therein to flow to one end for drainage. A plurality of dispersion assemblies 22 are connected to supply header 16, as may also be seen in FIG. 1. Supply header 16 and dispersion assemblies 22 may be partially or completely mounted within an air duct in an HVAC system for humidifying the airstream within the air duct.

Referring again to FIGS. 1 and 2, each dispersion assembly 22 preferably includes a substantially vertical steam dispersion tube 24 which is mounted above supply header 16 and has a top end 26 and a bottom end 28. A drain tube 30 is communicated with the bottom end 28 of each steam dispersion tube 24, for draining any liquid which may condense on the inner wall 42 of steam dispersion tube 24. The respective drain tubes 30 are preferably connected to a main drain line (not shown) for disposing or recovering the condensed liquid.

According to one novel aspect of the invention, each dispersion assembly 22 includes structure 32 for communicating the supply header 16 with the top end 26 of the steam dispersion tube 24. In the preferred embodiment of the invention which depicted in FIGS. 1 and 2, the header communicating structure 32 is embodied as a steam supply tube 34 which is mounted to and communicated with supply header 16 at a lower end 38, and is in communication with the top end 26 of steam dispersion tube 24 at an open upper end 36. As may be seen in FIGS. 1 and 2, steam supply tube 34 is positioned within steam dispersion tube 24 and is preferably coaxial with steam dispersion tube 24.

Each steam dispersion tube 24 has a plurality of orifices defined therein, each orifice having a tubelet 40 positioned therein, as is best shown in FIG. 2. Each tubelet 40 has a passage defined therein through which steam from steam dispersion tube 24 may be permitted to pass into the airstream surrounding steam dispersion tube 24. Each tubelet 40 is configured so as to extend into the steam dispersion tube 24 beyond the inner wall 42 of the steam dispersion tube 24, so that condensed liquid which may form on the inner wall 42 will not be injected into the airstream through the tubelet 40.

The top end 26 of steam dispersion tube 24 is closed. Preferably, the closure is accomplished by means of a cap 44 which is welded or otherwise secured to the top end 26. Preferably, all components of the dispersion assembly, including cap 44, steam supply tube 34, and steam dispersion tube 24 are fabricated from a corrosion-proof material, such as stainless steel.

In operation, when control system 20 opens valve 18 and steam is permitted to flow from source 12 into supply header 16, the steam will flow upwardly through the respective steam supply tubes 34 and be introduced into the steam dispersion tube 24 at its top end 26. The steam will impinge on the lower cap 44, and will reverse its momentum, flowing downwardly into the steam dispersion tube 24 outside of the steam supply tube 34. As the direction of the steam flow is reversed at top end 26, some of the moisture which may be entrained within the steam will collect on cap 44 and on the inner wall 42 of steam dispersion tube 24. This condensed and entrained moisture will run downwardly along the inner wall 42 and will be eliminated from the dispersion assembly 22 harmlessly by drain tube 30. This liquid will not be injected into the airstream, because of the inward protrusion of the tubelets 40 which are positioned in the orifices defined in the wall of steam dispersion tube 24.

One very important advantage which is created by the invention is that the downward flow of steam in the steam dispersion tube 24 will aid in the draining of entrained and condensed liquid from the dispersion assembly 22. If, on the other hand, steam were introduced directly into the bottom end 28 of steam dispersion tube 24, the upward flow of the steam would tend to hold entrained and condensed moisture up within the steam dispersion tube 24, which could cause spitting of the liquid into the airstream.

Figure 3:
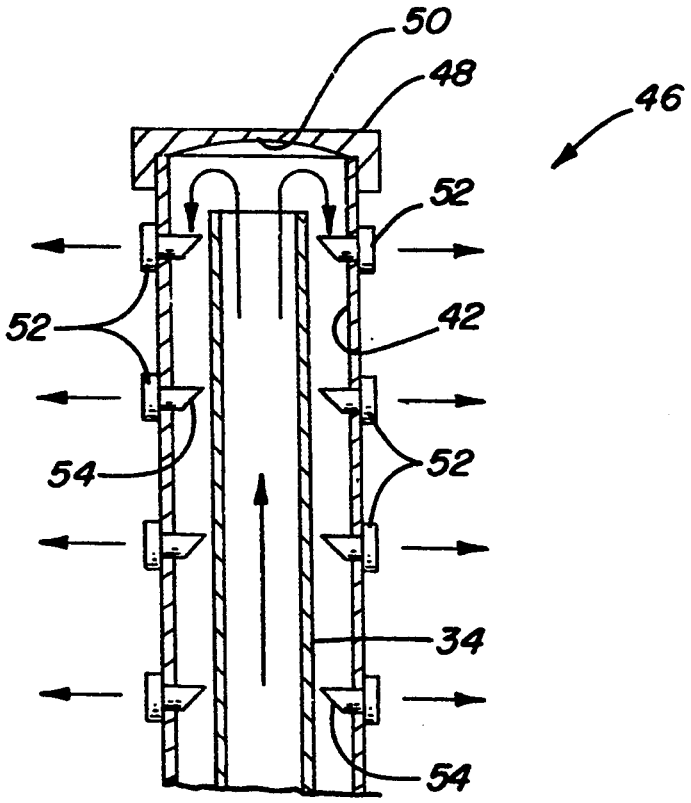
FIG. 3 is a cross-sectional fragmentary view of a portion of a humidification system which is constructed according to a second embodiment of the invention.

Referring now to FIG. 3, a dispersion assembly 46 constructed according to a second embodiment of the invention includes a cap 48 mounted to the top end 26 of steam dispersion tube 24 in place of the cap 44 depicted in FIGS. 1 and 2. Cap 48 includes a dome shaped lower surface 50 which helps guide steam from the steam supply tube 34 smoothly in its reversal of direction downwardly into the steam dispersion tube 24. Dispersion assembly 46 further includes modified tubelets 52, each of which have an angled inner end 54. The purpose of angled inner end 54 is to provide a hood adjacent to an entrance of the tubelet upon which entrained moisture will impinge without being drawn into the tubelet. In the most preferred embodiment, the angled end 54 is angled at approximately 45° to the longitudinal axis of the respective tubelet 52.

Figure 4:
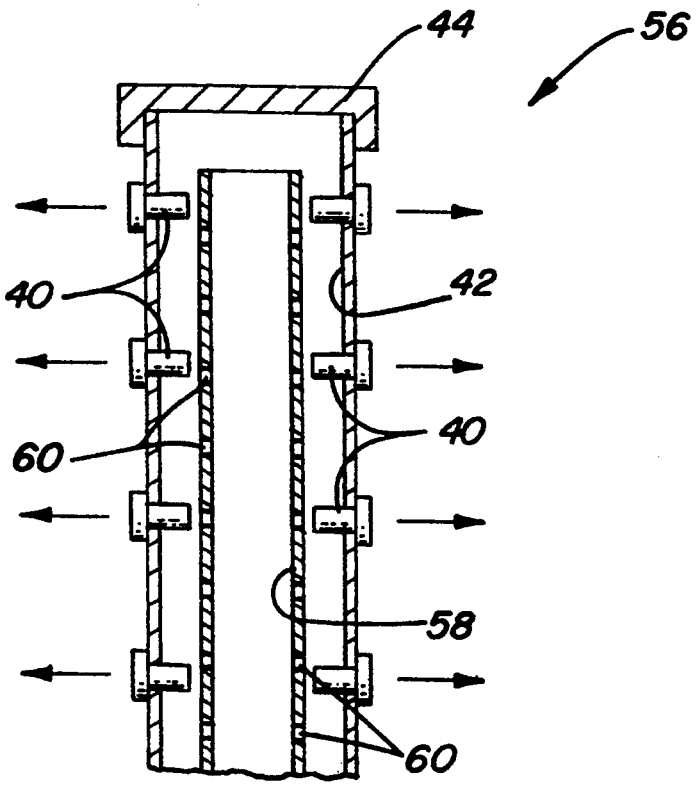
FIG. 4 is a cross-sectional fragmentary view of a portion of a humidification system which is constructed according to a third embodiment of the invention.

A dispersion assembly 56 constructed according to a third embodiment of the invention is depicted in FIG. 4. Dispersion assembly 56 includes a modified steam supply tube 58 having a plurality of holes 60 defined therein. Holes 60 help reduce pressure within the steam supply tube 34, which helps reduce back pressure in the system 10 for high volume applications.

It is to be understood, however, that even though numerous characteristics and advantages of the present invention have been set forth in the foregoing description, together with details of the structure and function of the invention, the disclosure is illustrative only, and changes may be made in detail, especially in matters of shape, size and arrangement of parts within the principles of the invention to the full extend indicated by the broad general meaning of the terms in which the appended claims are expressed.

What is claimed:

1. An apparatus for introducing steam into an airstream in an HVAC humidification system, comprising:

a supply header which is adapted for connection to a source of steam;

a steam dispersion tube, said steam dispersion tube having a top end, a bottom end, and a plurality of orifices defined therein;

drain means in communication with said steam dispersion tube for draining condensed liquid from said steam dispersion tube, said drain means being positioned beneath said top end of said dispersion tube; and a steam supply tube, positioned within said steam dispersion tube, for communicating said supply header with said top end of said steam dispersion tube, whereby entrained moisture droplets will be urged downwardly in said steam dispersion tube by gravity and the direction of steam flow toward said drain means rather than suspended in said steam dispersion tube as would be created by an upward flow of steam.

2. An apparatus according to claim 1, wherein said supply header is substantially horizontal.

3. An apparatus according to claim 1, further comprising a plurality of said steam dispersion tubes, drain means and header communicating means.

4. An apparatus according to claim 1, wherein said steam dispersion tube is substantially vertical.

5. An apparatus according to claim 1, wherein said steam supply tube has a longitudinal axis which is substantially parallel to a longitudinal axis of said steam dispersion tube.

6. An apparatus according to claim 5, wherein said steam supply tube and said steam dispersion tube are coaxial.

7. An apparatus according to claim 1, wherein said steam supply tube has a plurality of holes defined therein through which some steam is allowed to pass into said steam dispersion tube.

8. An apparatus according to claim 1, wherein said steam dispersion tube is integral with and secured about said steam supply tube.

9. An apparatus according to claim 1, wherein said steam dispersion tube is closed at said top end.

10. An apparatus according to claim 9, wherein said steam dispersion tube is dome-shaped at said top end to guide steam from said steam supply tube downwardly into said steam dispersion tube.

11. An apparatus according to claim 1, further comprising a plurality of tubelets positioned, respectively, in said orifices, each of said tubelets extending into said steam dispersion tube beyond an inner wall of said steam dispersion tube, whereby condensed liquid which may form on said inner wall will not be injected through said tubelet into the airstream.

12. An apparatus according to claim 11, wherein said tubelets have an inlet end within said steam dispersion tube and an outlet end, and said inlet end is angled to maximize the cross-sectional area of an entrance to said inlet end.

13. An apparatus for introducing steam into an airstream in an HVAC humidification system, comprising:

a supply header which is adapted for connection to a source of steam;

a steam dispersion tube mounted above said supply header, said steam dispersion tube having a top end, a bottom end, and a plurality of orifices defined therein;

a drain connected to said bottom end of said steam dispersion tube for draining condensed liquid from said steam dispersion tube; and a steam supply tube positioned within said steam dispersion tube, said steam supply tube having a lower end which is communicated with said supply header and an upper end which is communicated with said top end of said steam dispersion tube, whereby steam will be introduced into said top end of said steam dispersion tube and entrained moisture droplets will be urged downwardly in said steam dispersion tube by gravity and the direction of steam flow toward said drain rather than suspended in said steam dispersion tube as would be created by an upward flow of steam.

14. An apparatus according to claim 13, wherein said supply header is substantially horizontal.

15. An apparatus according to claim 13, further comprising a plurality of said steam dispersion tubes, drains and steam supply tubes.

16. An apparatus according to claim 13, wherein said steam dispersion tube is substantially vertical.

17. An apparatus according to claim 13, wherein said steam supply tube has a longitudinal axis which is substantially parallel to a longitudinal axis of said steam dispersion tube.

18. An apparatus according to claim 17, wherein said steam supply tube and said steam dispersion tube are coaxial.

19. An apparatus according to claim 13, wherein said steam supply tube has a plurality of holes defined therein through which some steam is allowed to pass into said steam dispersion tube.

20. An apparatus according to claim 13, wherein said steam dispersion tube is integral with and secured about said steam supply tube.

21. An apparatus according to claim 13, wherein said steam dispersion tube is closed at said top end.

22. An apparatus according to claim 21, wherein said steam dispersion tube is dome-shaped at said top end to guide steam from said steam supply tube downwardly into said steam dispersion tube.

23. An apparatus for introducing steam into an air stream in an HVAC humidification system, comprising:

a supply header which is adapted for connection to a source of steam;

a steam dispersion tube mounted above said supply header, said steam dispersion tube having a top end, a bottom end, and a plurality of orifices defined therein;

drain means connected to said bottom end of said steam dispersion tube for draining condensed liquid from said steam dispersion tube; and a steam supply tube, coaxial with said steam dispersion tube, for communicating said supply header with said top end of said steam dispersion tube, whereby entrained moisture droplets will be urged downwardly in said steam dispersion tube by gravity and the direction of steam flow toward said drain means rather than suspended in said steam dispersion tube as would be created by an upward flow of steam.

24. An apparatus for introducing steam into an air steam in an HVAC humidification system, comprising:

a supply header which is adapted for connection to a source of steam;

a steam dispersion tube mounted above said supply header, said steam dispersion tube having a top end, a bottom end, and a plurality of orifices defined therein;

drain means connected to said bottom end of said steam dispersion tube for draining condensed liquid from said steam dispersion tube; and header communicating means for communicating said supply header with said top end of said steam dispersion tube, said header communicating means comprising a steam supply tube which is positioned within said steam dispersion tube, said steam supply tube being communicated with said supply header at a lower end and having an upper end which terminates near said top end of said steam dispersion tube, whereby entrained moisture droplets will be urged downwardly in said steam dispersion tube by gravity and the direction of steam flow toward said drain means rather than suspended in said steam dispersion tube as would be created by an upward flow of steam.

25. An apparatus for introducing steam into an air steam in an HVAC humidification system, comprising:

a supply header which is adapted for connection to a source of steam;

a steam dispersion tube mounted above said supply header, said steam dispersion tube having a top end, a bottom end, and a plurality of orifices defined therein;

a plurality of tubelets positioned, respectively, in said orifices, each of said tubelets extending into said steam dispersion tube beyond an inner wall of said steam dispersion tube, said tubelets having an inlet end within said steam dispersion tube and an outlet end, said inlet end being angled to maximize the cross-sectional area of an entrance to said inlet end, whereby condensed liquid which may form on said inner wall will not be injected through said tubelet into the airstream;

drain means connected to said bottom end of said steam dispersion tube for draining condensed liquid from said steam dispersion tube; and header communicating means for communicating said supply header with said top end of said steam dispersion tube, whereby entrained moisture droplets will be urged downwardly in said steam dispersion tube by gravity and the direction of steam flow toward said drain means rather than suspended in said steam dispersion tube as would be created by an upward flow of steam.

* * * * *